United States Patent [19]

Conway

[11] 4,342,419

[45] Aug. 3, 1982

[54] SAFETY COVER FOR CENTRIFUGE BUCKET

[75] Inventor: George E. Conway, Newark, Calif.

[73] Assignee: Beckman Instruments, Inc., Fullerton, Calif.

[21] Appl. No.: 202,891

[22] Filed: Oct. 31, 1980

[51] Int. Cl.[3] ..... B04B 7/06; B04B 15/08

[52] U.S. Cl. ..... 233/1 A; 220/357; 220/367; 233/26

[58] Field of Search ..... 233/26, 1 A; 220/367, 220/358, 359, 357; 215/260, 262

[56] References Cited

U.S. PATENT DOCUMENTS

| | | | |
|---|---|---|---|
| 835,166 | 11/1906 | Staunton | 215/260 |
| 866,938 | 9/1907 | Kinsey | 215/262 |
| 2,872,064 | 2/1959 | Bruggman | 215/38 |
| 2,958,517 | 11/1960 | Harker et al. | 259/122 |
| 3,266,718 | 8/1966 | Stahl | 233/26 |
| 3,377,021 | 4/1968 | Fox | 233/26 |
| 3,456,650 | 7/1969 | Schwartzman | 128/249 |
| 3,459,369 | 8/1969 | Marks | 233/26 |
| 3,640,452 | 2/1972 | Thylefors | 233/1 A |
| 3,720,502 | 3/1973 | Gropper et al. | 23/292 |
| 4,024,857 | 5/1977 | Blecher et al. | 128/2 F |
| 4,051,970 | 10/1977 | Saleri et al. | 215/260 |

*Primary Examiner*—Robert W. Jenkins
*Attorney, Agent, or Firm*—R. J. Steinmeyer; F. L. Mehlhoff; Al A. Canzoneri

[57] ABSTRACT

The present invention is directed to a transparent safety cover for sealing the mouth of a pivotally mounted bucket of a centrifuge rotor. The cover has a first surface configured to make telescoping engagement with the sidewall of the rotor bucket. A shoulder adjacent the first surface abuts the top of the bucket to limit the length of engagement. The first surface has an annular groove containing a resilient O-ring which makes a seal between the cover and the bucket. In the upper portion of the cover, there is a raised dome-like structure with a circular aperture at the top. The aperture has inverted conical walls and is sealed by a movable, resilient, sealing plug. The plug has a tapered body and at the lower portion thereof, are wall gripping means for retaining the plug in a raised, unseated, position. With the plug in the unseated position, the bucket is vented to the atmosphere permitting telescoping movement of the cover with respect to the bucket. Additional means are provided to block inadvertent withdrawal of the plug from the aperture.

8 Claims, 4 Drawing Figures

SAFETY COVER FOR CENTRIFUGE BUCKET

BACKGROUND OF THE INVENTION

This invention relates to the field of centrifuges having a rotor with swinging buckets and, more specifically, to a cover for sealing the mouth of such buckets.

In the field of science and medicine, high speed centrifuges are frequently employed to process various reagent or pathogen samples. A typical centrifuge may have a plurality of buckets pivotally mounted around the periphery of the centrifuge rotor. When the rotor is at rest, the buckets hang vertically by force of gravity. When the rotor is revolving at high speed, strong centrifugal forces apply a moment of force to the buckets and cause them to swing out into a horizontal position.

A widely followed practice is to centrifuge a number of specimens at the same time. This is done by loading each bucket of the centrifuge rotor with a sufficient number of specimen containers to make up the desired load size. Typically, the specimen containers are in the form of capped glass test tubes, although plastic tubes, bottles, and bags are also used. Occasionally, a specimen container fails to withstand the force of centrifugation and breaks, and releases its contents in the centrifuge bucket. It is possible for the liquid contents so released to be generated as an aerosol (i.e. a shower of extremely small droplets) and, if the bucket is not covered, the aerosol can escape from the bucket—even during the centrifugation process. If the specimen released is of a harmful nature, the event could pose a serious hazard for the operator and other occupants of the laboratory.

Accordingly, in the interest of safety, some laboratories now require that a sealed cover be used over the opening of a centrifuge bucket containing test tubes in order to preclude the possible release of harmful substances outside of the bucket in the event of test tube breakage during centrifugation. Among the practical considerations applying to any such cover are first, that it seal effectively; then, that it be transparent so that the operator may observe the condition of the bucket contents before removing the cover; and finally, that the cover be simple to use and be either disposable, autoclavable, or otherwise sterilizable.

SUMMARY OF THE INVENTION

The present invention is directed to a safety cover for use on a swinging bucket of a centrifuge rotor. The cover is designed to seal the bucket so that, in the event that a test tube or other specimen container carried in the bucket ruptures during centrifugation, the cover will prevent dispersion of the specimen and thereby protect the operator, the centrifuge and the immediate environs from contamination by a possibly harmful substance. Preferably, the cover is transparent, so that the operator may observe the condition of the bucket contents before removing the cover.

In the preferred embodiment, the safety cover comprises a dome-like housing having a circular aperture with inverted conical walls in the top portion of the dome, and a captive movable sealing plug disposed in the aperture. With the sealing plug in an unseated position, the cover is assembled to the bucket in a form of telescoping engagement between a tubular extension of the cover and a wall of the bucket. Air displaced by the telescoping assembly of the cover and the bucket is vented through the circular aperture in the dome of the cover. The sealing plug, which is then positioned in the aperture, has a sidewall form mating with the conical walls of the aperture and is so designed as to seal itself automatically by the force of centrifugation.

An O-ring disposed in an annular groove encircling the tubular extension of the cover permits a seal between the bucket sidewall and the tubular extension of the cover; and a shoulder adjacent the tubular extension makes contact with the face of the bucket and thereby limits the extent of telescoping engagement between the two parts.

Additional features and advantages of the invention will become more apparent by reference to the detailed description and the accompanying drawings.

DETAILED DESCRIPTION

Figure 1:
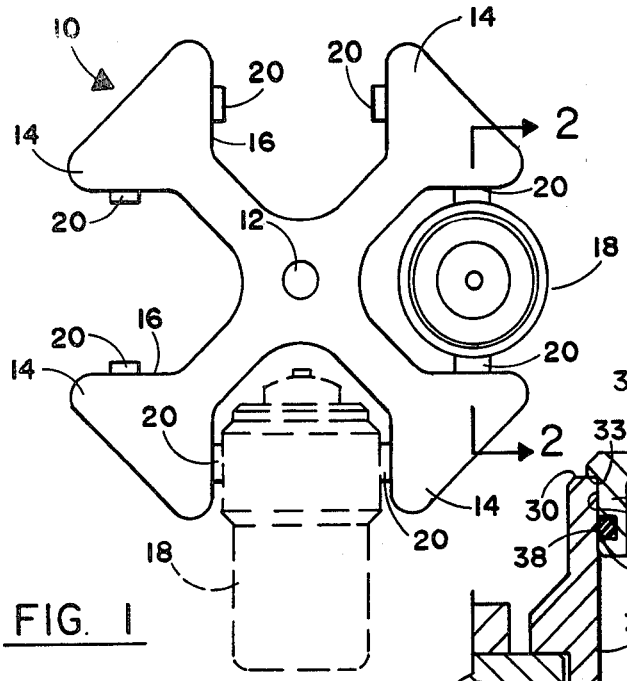
FIG. 1 is a top view of a bucket type rotor.

In FIG. 1 a swinging bucket type rotor 10 is shown mounted on a rotational shaft 12. The rotor 10 has a series of spaced radially extending arms 14 which form a plurality of gaps 16 designed to receive rotor buckets 18. These buckets are mounted within the rotor arms 14 on pivot pins 20 which allow the buckets to pivot within the gaps 16. Therefore, when the rotor is at rest, the bucket will assume the orientation shown in solid lines, while during the centrifugation operation, the bucket 18 will swing to the position shown in phantom lines.

Figure 2:
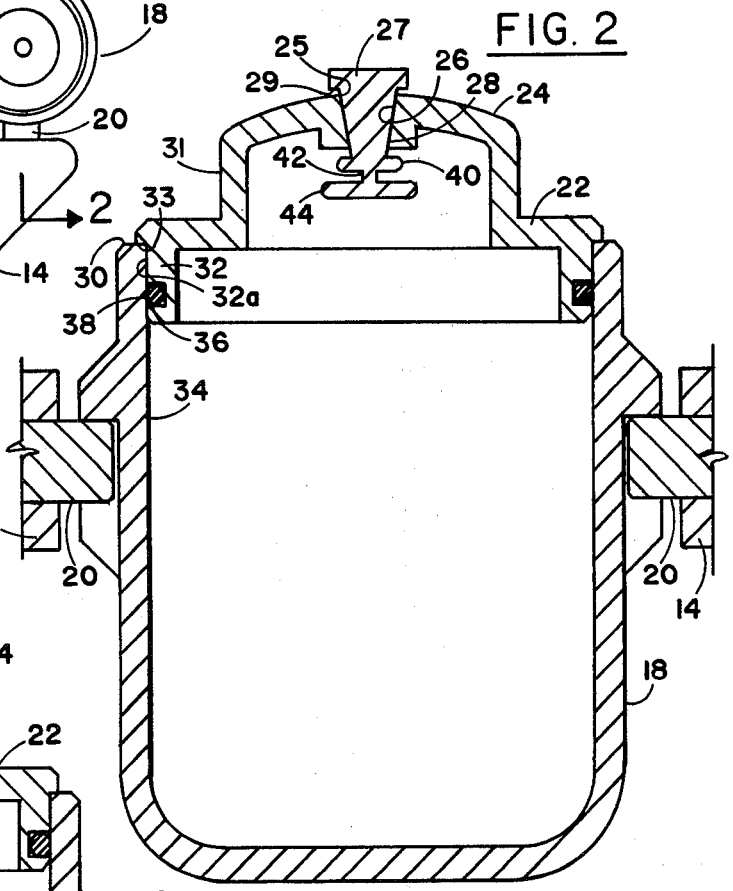
FIG. 2 is a sectional view taken along the line 2—2 of FIG. 1.

The rotor bucket 18 is shown in greater detail in FIG. 2. Emplaced over the mouth of the bucket is the cover 22 of the present invention. The cover 22 has a flange like external shoulder 33 which rests upon the top surface 30 of rotor bucket 18. Adjacent shoulder 33 is a tubular extension 32 having a first surface **32*a* which makes telescoping engagement with the interior wall 34 of the rotor bucket 18. An annular groove 36 encircles tubular extension 32 and contains a resilient O-ring 38** which enables effective sealing to be obtained between the cover and the interior wall of the bucket.

The cover 22 has a raised portion consisting of surface 31 and a dome-like top 24, which is provided as a grasping surface to facilitate handling of the cover during installation and removal from rotor bucket 18. Surface 31 may optionally include a perimeter recess (not shown) to enhance the ease with which the cover 22 may be grasped. At the center of the dome-like top 24, there is a circular aperture 25 having inverse frustoconical walls 26. The aperture 25 is sealed by a resilient plug 27 having a conical body 28. A circular shoulder adjacent the larger end of the conical body 28 forms a cap 29 by which the plug can be grasped to unseal aperture 25. It is necessary to unseat plug 27 in order to install or remove cover 22 from the rotor bucket 18. This is necessary, because the telescoping manner of assembly employed for these parts creates a pressure differential in the bucket which must be equalized in order to effect their assembly or disassembly.

Figure 3:
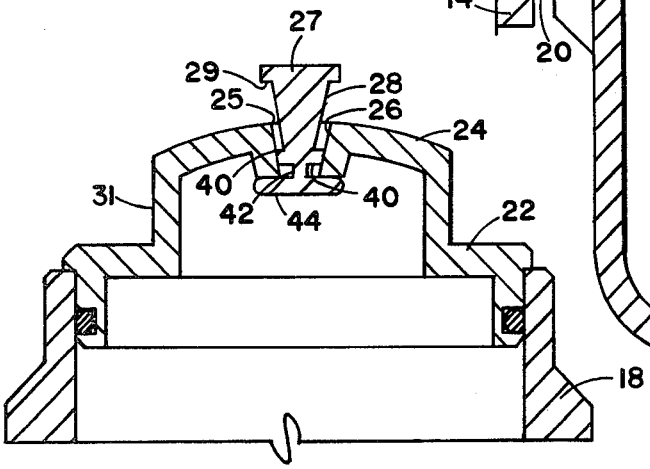
FIG. 3 is a section view of the cover of the invention with the vent plug in the open position.

Referring now to FIG. 3, there is shown a partial sectional view of cover 22 with plug 27 in an unseated position. The resilient plug 27 is retained in an open position by a pair of transverse protrusions 40 at the base of the conical body 28. The protrusions 40 are made slightly larger than the smallest portion of aperture 25 in order to grip the walls of the aperture and retain the plug in an unseated or venting position. This makes it possible for the user to either install or remove the cover with one hand. The user need not be concerned about re-seating plug 28 following the reinstallation of cover 22 on bucket 18, as the force of centrifugation will almost immediately seat the plug, to automatically seal bucket 18. The form and number of protrusions 40 is in no way critical, since it is only required that a slight interference be presented to the aperture wall to keep plug 28 in the unseated condition. Below protrusions 40, a short longitudinal extension 42 connects with retainer section 44. Retainer 44 has a transverse dimension considerably larger than the smallest diameter of aperture 25. This is to present sufficient interference to prevent plug 27 from being inadvertently separated from aperture 25 when it is raised to vent the cover 22.

In use, a centrifuge operator installs the cover 22 on each bucket 18 by first raising the plug 27 to the venting position and then placing the cover over the opening of the bucket. As previously stated, the force generated by centrifugation will automatically reseat the plug and thereby seal the bucket. If a specimen container ruptures during the centrifugation, its contents will, because of centrifugal force, impact the bottom of the rotor bucket in which it is carried. Immediately following the cessation of rotation, the bucket holding the ruptured container may contain some quantity of aerosol particles and gaseous vapor from the substance released by the rupture. If the substance is of a hazardous nature, exposure to it could seriously jeopardize the operator's safety. The cover of the invention, however, provides a vapor tight closure over the bucket and protects the operator from being inadvertently exposed to such a hazard. Preferably, the cover is made of transparent material so that the operator is able to view the contents of a bucket before venting and removing the cover. In the event he detects a container failure of a possibly hazardous material, he can take any special precautions necessary to protect his safety.

Safety covers can be fabricated, for example, of polysulfone which provides adequate transparency and can be sterilized by autoclaving or washing in a 10% solution of hydrogen peroxide. Resilient plugs for use in these covers have been satisfactorily fabricated from ethylene propylene rubber.

Figure 4:
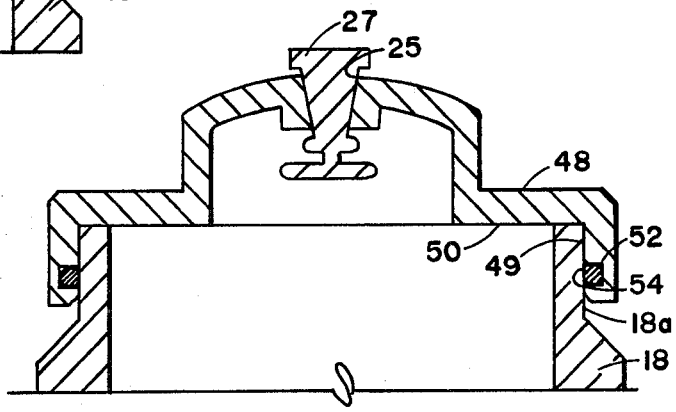
FIG. 4 is a section view of the cover of the invention in an alternate embodiment.

An alternate embodiment of the invention is depicted in FIG. 4. A safety cover 48 has a tubular recess 49 which makes telescoping engagement with the outer wall surface 18*a* of rotor bucket 18. An annular groove 52 is provided on surface 49 and contains an O-ring 54 which seals against surface 18*a* of bucket 18. Interior shoulder 50 contacts the top surface 30 of bucket 18 and thereby limits the length of engagement between cover 48 and bucket 18. Resilient plug 27 is deployed in the same manner as described in the previous embodiment.

The invention has been described in what is perceived to be its most practical embodiment; however, it will be apparent to those skilled in the art that various modifications and improvements may be made without departing from the scope and spirit of the invention. Accordingly, it should be understood that the invention is not to be limited by the specific illustrative embodiments, but only by the scope of the appended claims.

I claim:

1. A safety cover for sealing the mouth of a pivotally mounted bucket of a centrifuge rotor comprising:

a cover member having a;

raised dome-like housing;

an outer flange communicating with the base of said housing;

a tubular extension of slightly smaller size communicating with the lower side of said flange;

said tubular extension configured to make telescoping engagement with the sidewall of said bucket, and the depth of said engagement limited by the point at which said flange contacts the top surface of said bucket;

a groove encircling said tubular extension;

a resilient O-ring disposed in said groove for effecting a seal between the cover and the bucket; and means in the cover for venting air from the bucket during telescoping movement of said cover with respect to the bucket, said means automatically sealing during centrifugation.

2. The safety cover recited in claim 1, wherein said tubular extension is of circular cross-section and engages an interior cylindrical surface of the sidewall of said bucket.

3. The safety cover recited in claim 1, wherein said tubular extension is a circular cross-section and caps the exterior cylindrical sidewall of said bucket.

4. The safety cover recited in claim 1, wherein said cover is transparent.

5. The safety cover recited in claim 1, wherein said cover is made of polysulfone.

6. A safety cover for sealing the mouth of a pivotally mounted bucket of a centrifuge rotor comprising:

a cover member having a first surface configured to make telescoping engagement with the sidewall of said bucket;

a shoulder adjacent said first surface adapted to contact the top surface of said bucket and thereby limit the length of telescoping engagement therebetween;

an annular groove encircling said first surface;

a resilient O-ring disposed in said annular groove for effecting a seal between the first surface of the cover and the sidewall of the bucket;

a circular aperture having inverted conical walls in the top of the cover;

a resilient plug having a conical body disposed in said aperture for sealing said aperture;

means adjacent the larger diameter of said conical body for grasping said plug;

a portion of the body of said plug adjacent the smaller diameter of its conical portion made slightly larger than the smallest diameter of said aperture to enable the plug to be retained in a raised venting position while stationary; and said plug having a longitudinal extension at its lower portion terminating in a section of expanded size having a transverse dimension larger than the smallest diameter of said aperture to retain said plug captive against inadvertent removal from said cover.

7. The safety cover recited in claim 6, wherein said means for grasping said plug comprise a circular shoulder adjacent the larger diameter of said conical body.

8. A safety cover for sealing the mouth of a pivotally mounted bucket of a centrifuge rotor comprising:

a cover member having a dome-like housing and a circular aperture with inverted conical walls in the top portion of said dome;

an outer flange of circular cross-section communicating with the base of said dome;

a tubular extension of slightly smaller diameter communicating with the lower side of said flange;

said tubular extension configured to make telescoping engagement with the sidewall of said bucket, and the depth of said engagement limited by the point at which said flange contacts the top surface of said bucket;

an annular groove encircling said tubular extension; and a resilient O-ring disposed in said groove capable of effecting a seal between the cover and said bucket;

a captive, movable sealing plug disposed in said aperture, wherein said plug is adapted to be positioned in an upward position to permit air to escape when said cover is installed in telescoping engagement with said bucket, and wherein said plug automatically seals said aperture during centrifugation as a result of centrifugal forces acting thereupon.

* * * * *

UNITED STATES PATENT AND TRADEMARK OFFICE

CERTIFICATE OF CORRECTION

PATENT NO. : 4,342,419

DATED : August 3, 1982

INVENTOR(S) : George E. Conway

It is certified that error appears in the above-identified patent and that said Letters Patent are hereby corrected as shown below:

Claim 1, column 4, line 4, delete semicolon (;).

Signed and Sealed this

Twelfth Day of October 1982

[SEAL]

*Attest:*

GERALD J. MOSSINGHOFF

*Attesting Officer*

*Commissioner of Patents and Trademarks*